United States Patent [19]

Klepacz et al.

[11] 3,993,015

[45] Nov. 23, 1976

[54] HYDRAULIC JET PROPULSION SYSTEM

[75] Inventors: Janusz Klepacz; Joseph Menet, both of West Nyack, N.Y.

[73] Assignee: Janusz Klepacz, West Nyack, N.Y.

[22] Filed: Nov. 14, 1975

[21] Appl. No.: 631,992

Related U.S. Application Data

[63] Continuation of Ser. No. 407,852, Oct. 19, 1973, abandoned.

[52] U.S. Cl. ..... 115/14

[51] Int. Cl.[2] ..... B63H 11/02

[58] Field of Search ..... 115/12 R, 14–16; 114/150–151; 60/221–222, 228, 230; 285/411; 239/265.19, 265.29

[56] References Cited

UNITED STATES PATENTS

| | | | |
|---|---|---|---|
| 3,185,124 | 5/1965 | Spence | 115/16 |
| 3,233,573 | 2/1966 | Hamilton | 115/16 |
| 3,248,876 | 5/1966 | Parsons | 115/12 R |
| 3,250,475 | 5/1966 | Smith | 115/16 |
| 3,283,737 | 11/1966 | Gongwer | 115/16 |
| 3,343,368 | 9/1967 | Castocdi | 115/16 |
| 3,426,724 | 2/1969 | Jacobson | 115/16 |
| 3,446,177 | 5/1969 | Thornburg et al. | 115/16 |
| 3,675,424 | 7/1972 | Oosterveld | 115/12 R |

FOREIGN PATENTS OR APPLICATIONS

| | | | |
|---|---|---|---|
| 928,433 | 11/1947 | France | 285/411 |
| 889,096 | 2/1962 | United Kingdom | 115/16 |

*Primary Examiner*—Trygve M. Blix
*Assistant Examiner*—Jesus D. Sotelo
*Attorney, Agent, or Firm*—Cooper, Dunham, Clark, Griffin & Moran

[57] ABSTRACT

An hydraulic propulsion system for watercraft involving the forming of a parallel-sided, open-ended inlet intake tunnel with a recessed intake screen at the rear of the craft, which tunnel directs the incoming water flow into a single or multi-stage cylindrical axial pump having multi-vaned matched impellers and straighteners for driving the flow into an unobstructed acceleration chamber which converges the flow according to the rule of minimal flow losses, and discharges it as a jet through a cylindrical opening with controls thereat to propel and steer the craft. The intake tunnel and the acceleration chamber may be formed of fiberglass, with the former being laminated or molded into the hull of the craft, and the overall system may be of simplified, light-weight, compact construction while producing at least 15% greater thrust than conventional propulsion systems, and much greater thrust than prior hydraulic jets, of comparable power, installed in the same craft.

30 Claims, 16 Drawing Figures

HYDRAULIC JET PROPULSION SYSTEM

This is a continuation of application Ser. No. 407,852, filed Oct. 19, 1973, now abandoned.

BACKGROUND OF THE INVENTION

The present invention relates to hydraulic propulsion apparatus and more particularly to improvements in hydraulic jet propulsion systems for watercraft.

Hydraulic jet propulsion systems of the type to which the present invention is directed generally comprise a water conduit arrangement disposed at the rear of the watercraft to be propelled, which conduit consists of an intake section, a pump section, and a discharge section. Surrounding water from under the craft is drawn into an intake passage provided with a flow filtering screen in the intake section and passes to the pump section. The energy of the water incoming to the pump section, from the intake section, is increased by a pump assembly during flow through the pump section so that water with increased energy leaves the pump section and flows into a discharge chamber passage in the discharge section. In the discharge chamber passage there occurs an increase in the speed of water flow due to the drop of its static pressure, to a level about equalling the atmospheric pressure above the surrounding water surface at the cylindrical exit of the chamber. At the cylindrical end of the discharge chamber passage, the water is ordered into an organized flow. Upon leaving the end of the discharge chamber passage, the water in the form of an organized jet exerts a force on the propulsion system equalling the mass of discharging water, times the difference of its speed in relation to the speed of the craft equipped with the system minus the speed of said craft in relation to the surrounding water.

In order to steer the craft, there are attached control means to the propulsion system consisting of direction and reversing means.

The pump assembly, which increases the energy of water flow, is driven by a prime mover, usually an engine within the craft or of the outboard type, which is connected to the pump assembly, by a drive shaft directly or by a drive transmission.

In the past the various sections of the propulsion system have involved structural arrangements with complicated, heavy and expensive parts requiring constant & time-consuming maintenance and resulting in limited overall efficiency. Propulsion systems of the hydraulic jet type, consequently have found little application in smaller watercraft using power plants of under 100 HP output.

The present invention embodies several improvements and simplifications in construction which provide an hydraulic jet propulsion system whose total efficiency attains and even exceeds that of conventional propulsion systems such as Outboard (O/B), Inboard-Outboard (I/O) and Inboard (I/B).

Also, the static thrust of the present hydraulic jet propulsion system and its thrust in the low speed range which is necessary to permit rapid craft movements in conditions of sliding, is at least 15% higher than the same thrust of the said conventional propulsion systems installed in the same craft (i.e., boats of the same shapes and weights), using the same power engine, with equivalent maximum speeds.

Accordingly, the present invention involves the application of new construction means to hydraulic jet propulsion systems that results in a system of minimal dimensions (gabarit) and decidedly less weight than currently manufactured jet propulsion systems. It further results in a propulsion system of greater simplicity, greater reliability in functioning, and lower production costs.

In addition, this invention permits proper location of the propulsion system in the hull of the boat, so that the space taken up by the system and its prime mover is small; and the assembly and disassembly of the main sections of the system takes less than twenty minutes.

SUMMARY OF THE INVENTION

The present invention embodies an hydraulic jet propulsion system for compact disposition in the rear of the watercraft to be propelled, comprising an improved low-resistance intake passage which may be integrally molded into the craft hull and an externally disposed axially aligned pump assembly and discharge chamber which are connected to each other and the intake passage by readily releasable ring clamps for quick assembly and dismantling.

The intake passage is formed of parallel side walls and an aftwardly inclined front wall which are smoothly joined to form an open-ended rectangular intake opening and a cylindrical outlet opening in cooperation with a rear edge member disposed above the intake opening. A recessed screen formed of parallel streamlined bars inclined to the direction of the incoming water is mounted between the rear edge member and the passage front wall through which the pump drive shaft also extends.

The pump assembly is axially aligned with the passage outlet opening and comprises one or more impellers mounted on the drive shaft with more than four suitably formed blades on each and a cylindrical casing containing matched straightener vanes disposed downstream of the impellers. The drive shaft is supported in a plastic bearing in the hub of the leading straightener vanes which bearing is formed with grooves to permit the passage of water for lubrication. Auxiliary water outlets to the engine cooling system are also located in the pump section.

The discharge chamber is axially aligned with the pump section and contains an unobstructed acceleration chamber with an annular wall of aftwardly decreasing cross-section in accordance with the rule of minimal flow loss at the end of which is disposed a cylindrical outlet opening.

Direction steering and reversing means are mounted on the outside of the cylindrical discharge outlet opening and comprise an horizontally maneuverable cylindrical pipe fitted with cylindrical closing segments in the incline-permitting cutouts at each side and a dual cup reverser pivotable on said steering pipe to divert the flow from its exit.

The entire system provides a low-resistance flow passage affording greater efficiency in water propulsion and since the intake passage and discharge chambers may both be made of fiberglass, a system of simple, light, inexpensive, corrosion-resistant construction. Also since the pump assembly and discharge chamber is disposed outside of the rear of the craft, access for maintenance is facilitated and the space taken up within the craft hull is significantly reduced to accommodate only the prime mover.

BRIEF DESCRIPTION OF THE DRAWINGS

The details of this invention will be described with reference to the accompanying drawings in which.

DETAILED DESCRIPTION OF THE PREFERRED EMBODIMENT

Figure 1:
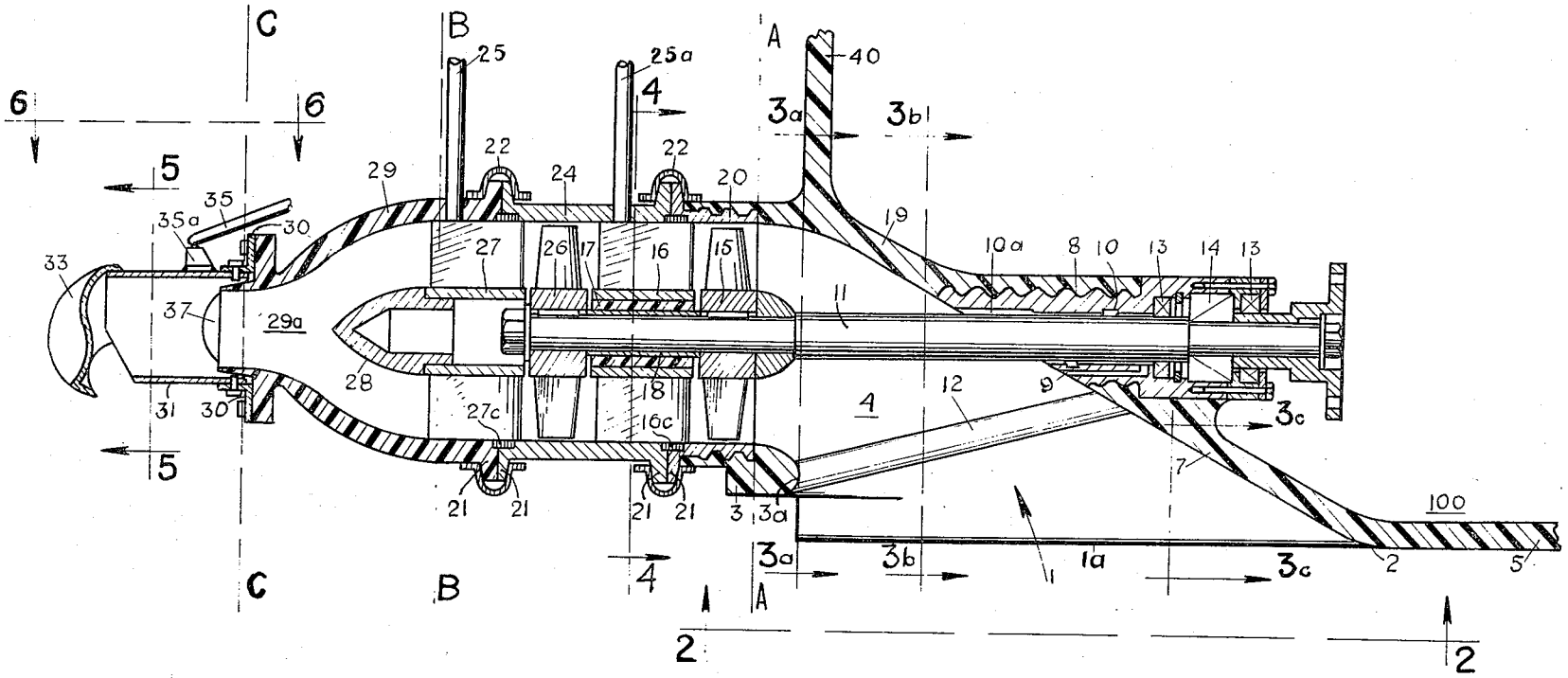
FIG. 1 is an axial sectional view in elevation of an hydraulic jet propulsion system in accordance with the present invention.

Referring to FIG. 1, there is shown a water conduit which is disposed at the rear of a watercraft 100, such as a speedboat or cabin cruiser, in which the present invention is incorporated. The conduit comprises an intake section 19, defining an intake passage 4, extending upwardly from the bottom surface of the craft hull 5 to line A—A; a pump section extending from line A—A to line B—B; and a discharge section containing an acceleration chamber extending from line B—B to its outlet end at line C—C. Discharge flow control means, 31 and 33, are disposed at the outlet of the conduit.

Figure 2:
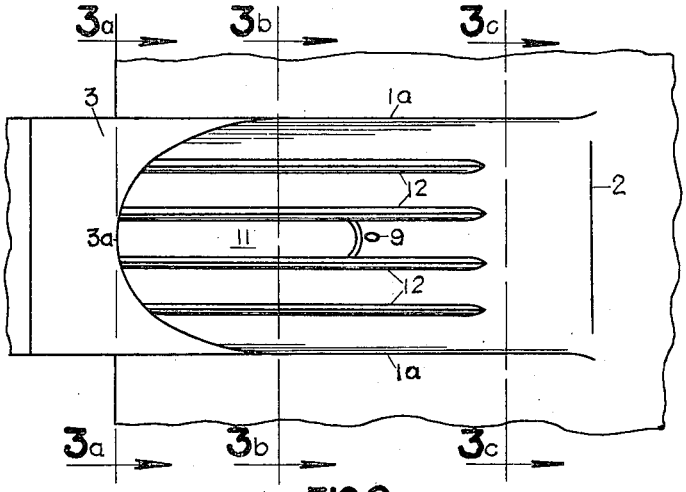
FIG. 2 is a bottom view of the intake opening, taken along line 2—2 in FIG. 1.

The intake section, more particularly, comprises an intake passage 4, communicating at one end with an intake opening 1 (see also FIGS. 2–4) formed in the bottom of the hull 5 of the craft in which the system is installed and at the other end with the entrance to the pump section with a series of screening bars 12 disposed therein. As seen in FIG. 2 the side edges 1*a* of the intake opening 1 are substantially parallel to each other; the front edge 2 is substantially perpendicular to side edges 1*a*, and to the longitudinal axis of the craft; and the rear edge is open. A member 3 forming the rear edge of the passage above the intake opening 1 has an elliptical shape.

The intersections of side edges 1*a* and front edge 2 are suitably smoothed to produce rounded surfaces which facilitate waterflow without turbulence. The side edges 1*a* of intake opening 1 at the intersection of the intake section side walls 4*a* and the adjacent bottom surfaces of the hull 5, are also suitably rounded off. The leading edge 3*a* of rear edge member 3 of the intake passage 4 is disposed above side edges 1*a* and also is rounded off.

Figure 3A:
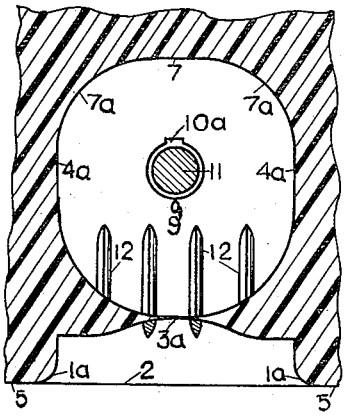
FIGS. 3*a*, 3*b*, and 3*c* are transverse sectional views of the intake passsage, respectively taken along the lines 3*a*—3*a*, 3*b*—3*b* and 3*c*—3*c* in FIGS. 1 and 2.
Figure 3B:
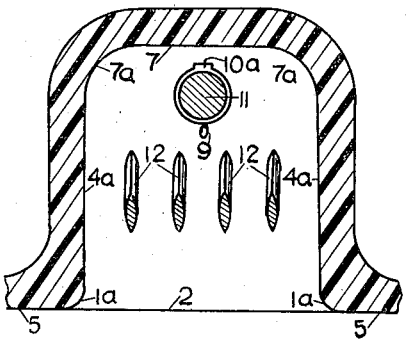
Figure 3C:
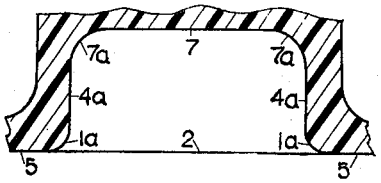
Figure 4:
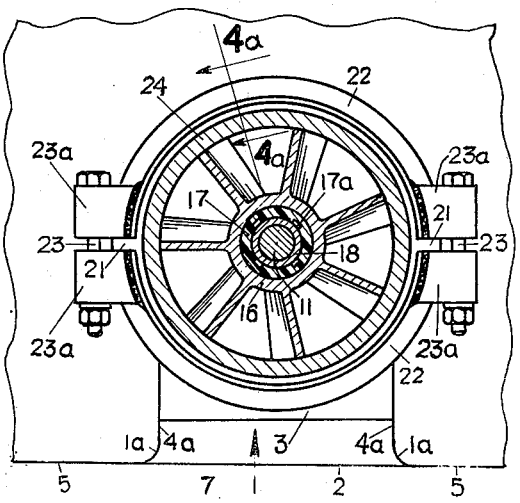
FIG. 4 is a sectional view taken along line 4—4 in FIG. 1.

Intake passage 4 generally consists of two substantially vertical side walls 4*a* and an inclined front wall 7 which are connected by concave round-off 7*a*. As seen in FIGS. 3*a*–3*c*, the round-offs 7*a* as they approach the pump section have a smoothly increasing curve and at the pump section entrance have a shape which renders the intake passage exit approximately cylindrical. A drive shaft 11, connecting the pump assembly with the prime mover of the craft, extends through passage 4 from front wall 7 into the pump section.

Rear edge member 3 of the intake passage 4 supports an inclined intake passage screen composed of bars 12, and the bottom of a connecting or joining ring 20 (FIG. 1), and is connected with the side walls 4*a* of the intake section in a similar manner as front wall 7. Front wall 7, which essentially forms the shape of the intake section, comprises a surface inclined to the axis of the drive shaft 11 preferably at an angle of approximately 25° (or within the range from 15° to 30°) and connected with the outer surface of the hull bottom 5 by a gentle curved surface minimizing intake flow turbulence. A bearing housing 8 is disposed in front wall 7 for supporting drive shaft 11.

The intake section is preferably made of fiberglass which is reinforced at the junction with connecting ring 20 and bearing housing 8. The entire section is preferably molded as a unit containing the ring 20 and housing 8. Water seals 13 and a combination thrust and journal bearing 14, may then be mounted in housing 8 and the drive shaft installed.

The intake section and the craft hull can be manufactured jointly as one piece, or the intake section may be laminated into the hull bottom, if they are manufactured separately or if the propulsion system is installed in an existing boat. This form of manufacturing or construction offers the advantages of greater rigidity and water tightness of the intake section and hull assembly than prior art intake castings; transfers and distributes greater force from the propulsion apparatus to the hull; and creates an improved low turbulence water flow passage which is necessary to achieve higher propulsion system efficiency.

With the use of prime movers of increased power for driving the pump section there is a need of more intensive cooling of the housing 8 of the thrust bearing 14. For this purpose water from intake passage 4 is permitted to flow, through a hole 9 in front wall 7, into a spiral recess 10 on the inside surface of the shaft opening in bearing housing 8. The direction of the advance of the spiral recess 10 is the same as the direction of the drive shaft's rotation when the prime mover is running. Spiral opening 10 has an outlet 10*a* above shaft 11.

Within intake passage 4 the intake screen is preferably in the form of a grill composed of parallel bars 12 disposed lengthwise of the hull 5. As seen in FIGS. 3*a*–3*c*, these bars 12 have streamlined or hydrofoil cross-sections to create minimal resistance to the incoming flow of water. The distance between the individual bars 12 may be in the range from 0.5 and 1.5 inches. The lower ends of bars 12 do not extend below edge 3*a* so that they are recessed and disposed entirely above the level of the hull bottom and are inclined to the direction of incoming water so as to make their length as short as construction permits to further minimize their resistance to the incoming flow. The bars may be made of stainless steel and are laminated into the intake section.

The intake section is installed in the hull bottom at the rear in such a way that the front edge 2 of intake opening 1 is substantially perpendicular to the longitudinal axis of the craft and the rear edge 3*a* of intake opening 1 reaches approximately to the outer surface of the hull transom 40 (FIG. 1). The outer surface of the intake section extends aftwardly from the transom 40 and is substantially cylindrical with an annular flange on connecting ring 20 extending peripherally outward from its end for the connection of the pump section thereto.

The pump section, as seen in FIG. 1, from line A—A to line B—B, is shown to contain a two-stage axial pump. This pump assembly comprises a cylindrical casing 24 containing respective front and rear impellers 15 and 26 with matched aftward flow straightening apparatus 16 and 27. However, the parts are so arranged and connected in axial alignment that disassembly of cylindrical casing 24 from the intake section and the removal of straightening apparatus 16 and impeller 26 is facilitated and permits the ready modification of the pump assembly into a new one-stage axial pump. On the other hand, the addition of further sections of cylindrical casing such as casing 24 with the attendant addition of an appropriate number of flow straightening apparatus and impellers will create a new multistage axial pump. These changes will be accompanied by appropriate modifications of the drive shaft and discharge chamber with the proper diameter of outlet.

Figure 10:
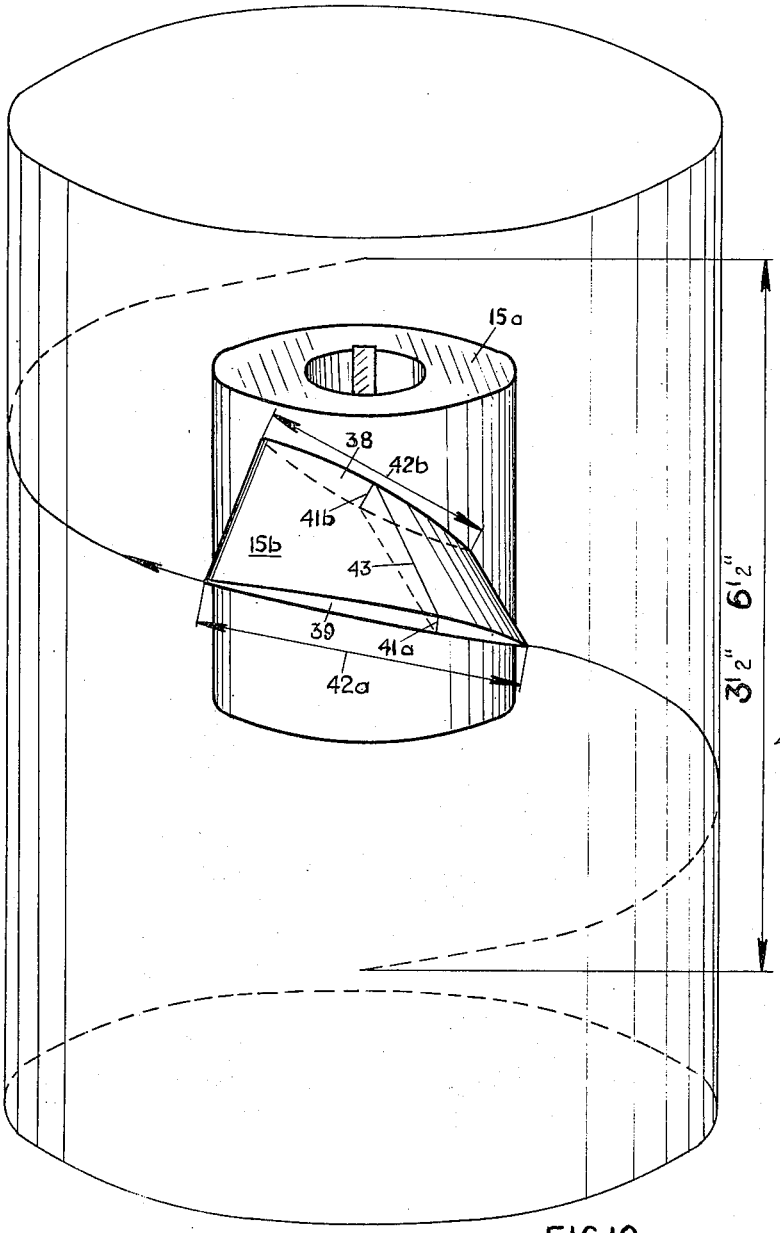
FIG. 10 is a prespective view of one impeller blade illustrating the arrangement and pitch as mounted on its hub.
Figure 11:
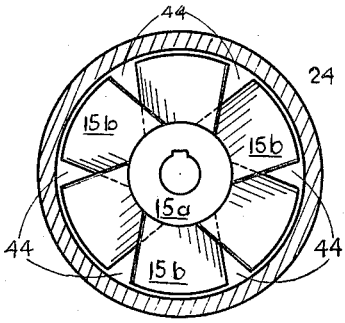
FIG. 11 is a front view of an impeller disposed in the flow passage illustrating the freeflow opening, arrangement and shape of the blades.

With particular regard to the parts of the pump assembly, the impeller blades are shaped in accordance with the conventional rule of constant pitch and have a pitch generally of about 6 inches. The particular pitch will be selected in accordance with the power and maximum RPN of the engine used and the required acceleration of the flow in the final stage of the discharge chamber. Thus, referring to FIG. 10, each of the impeller blades, one of which 15*b* is shown, shaped as indicated above, are mounted to the impeller hub 15*a* with their outer profiles 39 arranged at an angle which forms a pitch preferably in the range from 3½ to 6½ inches. The shape of the blade outer profile has a laminar configuration with a maximum offset thickness 41*a* toward the aft end. The profile at the hub end is also of a laminar nature and its maximum offset thickness 41*b* is at the middle. The intermediate profiles of the blades have their maximum thichnesses lying along a straight line 43 between the maximum thicknesses of the outer and inner profiles. The freeflow opening 44 of the impeller as shown in FIG. 11 is preferably in the range from 0 to 20% of the total area of the flow passage and the outline shape of the blades 15*b* is of an isoceles trapezoidal configuration with the narrow sides located at the hub end. The maximum relative thickness (i.e., the profile maximum thickness (41*a*)/the profile length (42*a*) ×100%) of the blade outer profile 39 is preferably in the range between 2% and 4% and of the blade inner profile 38 (41*b*/42*b* ×100%) is preferably in the range between 6 and 10%.

Figure 12:
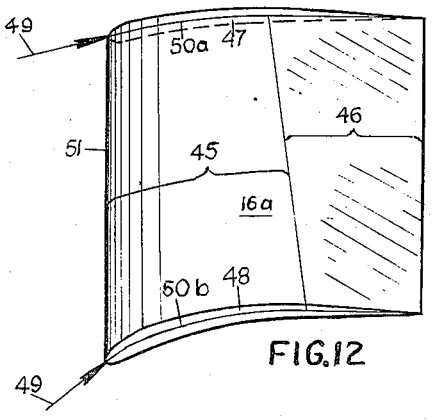
FIG. 12 is a perspective view of a straightener vane illustrating its shape and profiles and the tangential water flow.
Figure 13:
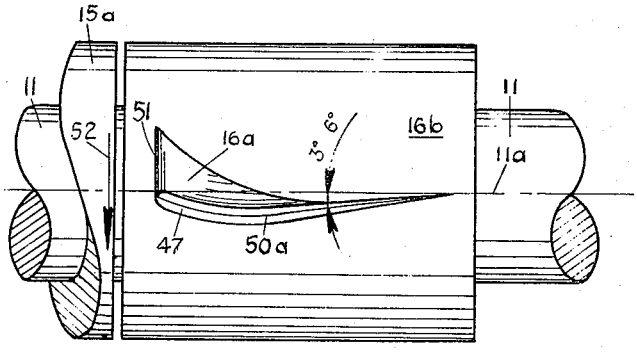
FIG. 13 is top view of a straightener vane illustrating its mounting on its hub.

The vanes 16*a* of the straightening apparatus as shown in FIGS. 12 and 13 each have a curved leading surface 45 and a straight trailing surface 46 when viewed in section. The length of the straight trailing surface or flat portion 46 decreases from the outer vane profile 47 toward the hub profile 48. The curvature of the centerlines 50*a* and 50*b* of the profiles should be designed to vary in accordance with the points of intersection of the tangential flow 49 of the water with the centerlines of the continuum of profiles, between 50*a* and 50*b*, on the leading edge 51. The optimum design operating condition should be selected to occur at an impeller RPM equal to about 95% of the maximum RPM. The straightener vanes 16*a* are mounted on the hub 16*a* (FIG. 13) in such a manner that their straight or flat portions 46 are inclined at an angle of approximately 3° to 6° from the drive shaft axis 11*a* in a direction opposite to the direction 52 of advance of the rotating impeller. The number of straightener vanes is selected with respect to the number of impeller blades in such relation that at any speed the resonance and noise levels are minimized. In all cases, however, the number of impeller blades is preferably five or more, and while the number of straightener vanes may be less than that of the impeller blades, it should not be less than five to prevent cavitation in the flow, and may usually be one more than the number of impeller blades.

The entire pump assembly, whether single or multistaged, is axially symetrically disposed in the cylindrical pump section with the straightening apparatus, 16 and 27, attached front and rear to the cylindrical casing 24 and disposed aft of the respective impellers 15 and 26, in an arrangement of improved simplicity and efficiency over pumps of the prior art. It has been determined that with the present arrangement the static thrust per horsepower of this pump assembly is 50 to 60% greater than that of prior art arrangements. Thus single stage arrangement can be used in smaller boats with engines up to 100 HP and stages may be added readily to produce higher speeds. The use of impellers with more than four blades has proved to provide improved power transfer when constructed and matched as described above.

The impellers 15 and 26 are mounted on the aft part of drive shaft 11 which rests on a bearing 17, of plastic such as Teflon, disposed in the hub of straightener 16. A bearing sleeve 18, on shaft 11 within bearing 17, acts to properly space the impellers and rotates with them. Bearing 17 is provided with axial grooves 17*a* to permit water to pass through and lubricate is interface with bearing sleeve 16.

Straightening apparatus 16 and 27 are substantially identical and have shroud rings 16*c* 27*c* attached about the straightener vanes by welding and set in a slight distance from the leading edge of the vanes. These rings 16*c* and 27*c* are respectively fitted tightly within annular recesses in ring 20 and cylindrical casing 24. To the rear of the hub of straightener 27 a central fairing 28 is fitted and extends into the discharge chamber 29 along with the rear edges of the straightener vanes.

Figure 4A:
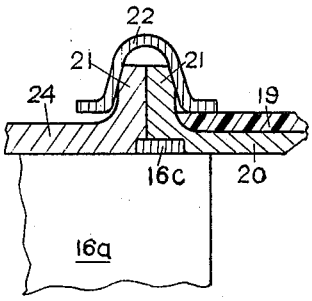
FIG. 4*a* is a sectional view of the clamping means taken along the line 4*a*—4*a* in FIG. 4.
Figure 5:
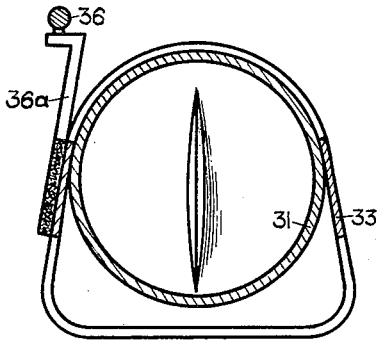
FIG. 5 is a view in partial section of the thrust reverser, taken along line 5—5 in FIG. 1.
Figure 6:
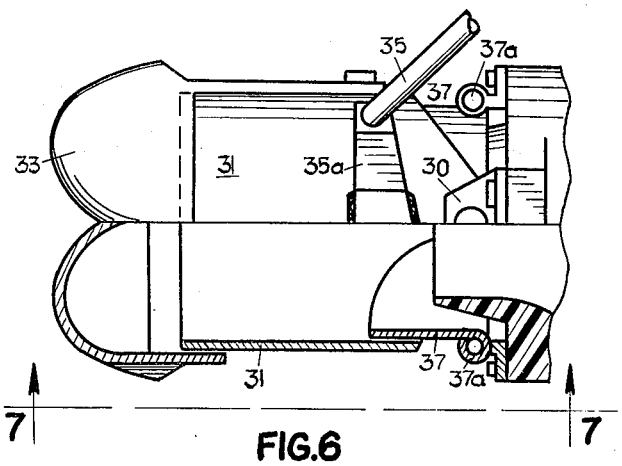
FIG. 6 is a top view in partial section of the control means, taken along line 6—6 in FIG. 1.

The means of joining pump section casing 24, to intake section joining ring 20 and discharge section 29, as well as joining additional stages of the pump assembly, or discharge section 29 directly to joining ring 20, comprises identical ring clamp members 22. As shown in FIGS. 1 and 4*a*, clamps 22 are formed with rounded annular recesses which are tightened over mating flanges 21 on the respective sections by bolts 23 within clamp fittings 23*a*. The inner walls of the recesses as seen in FIG. 4*a* tightly engage the outer surfaces of the flanges which may be inclined from the vertical by a slight angle to create a firm fit between the inner flange surfaces and the clamp-flange surfaces as the bolts 23 are tightened on the ring clamp. In addition to the arrangement shown in FIG. 4, the clamps 22 may be in the form of a single open ring element or divided into two ring segments as in FIG. 4 and hinged at one joint so that only a single bolt is required. These ring clamps provide a simple and effective joining means for the entire assembly and permit the system to be assembled and dismantled quickly and easily in less than twenty minutes.

The casing of discharge section 29 as seen in FIG. 1 actually extends from its inlet end forward of line B—B to its outlet end slightly beyond line C—C. However, the interior of discharge section 29 consists of three functionally differing sections.

The first section, extending from the inlet end of the discharge section casing at the joining with casing 24 to line B—B is the cylindrical aft part of the pump section and is of the same diameter as the fore part of the pump section so that the entire flow channel of the pump section is of the same diameter. In addition to part of the rear straightening apparatus 27 this section may contain an outlet for auxiliary water tapped off to the engine cooling system through conduit 25 which is located at a point between rear impeller 26 and acceleration chamber 29*a*. This location results in water withdrawal at a point of maximum pressure so that the smallest diameter outlet is permissible and water flow resistance is smaller. A second conduit 25*a* for extracting auxiliary water can be placed aft of the first stage of the pump assembly.

The second section of discharge section 29, extending from line B—B to line C—C is an acceleration chamber 29*a*. This chamber 29*a* is characterized by an annular wall of smoothly diminishing cross-section aftwardly. The interior surface of the water passage from line B—B to line C—C is formed according to the well-known rule of minimal flow losses to concentrate the flow rearwardly. The entrance of the acceleration chamber 29*a* contains the aft edge portions of the flow straightening vanes, but for the most part the acceleration chamber is unobstructed.

The third section of discharge section 29 extends from line C—C to its outlet end. The entire third part of the discharge section is of cylindrical shape. Its function is to equalize the flow of discharging water to produce an ordered jet of water with maximum thrust.

The whole discharge section casing may be made of fiberglass resulting in a reduction in weight and ease in forming, just as with the intake section, over its prior art counterparts.

An additional function of the end of the discharge section is to carry suitable control means. The control means consists of direction steering means and reversing means.

Direction steering is carried out by a cylindrical pipe 31, which is pivoted in mountings 30 fastened on discharge section 29. Inclining of the pipe 31, in an horizontal plane about the longitudinal axis of the boat, is made possible by forming cutouts 31*a* on both sides of the pipe 31. Inclining of pipe 31 to the right or left causes the water flow from the end of the discharge chamber to produce a thrust in the opposite direction. This thrust results in a change in the direction of travel of the boat in the direction of incline of the pipe.

To cover the openings which appear between the cutout pipe edges 31*a* and the outlet end of the discharge chamber, during the steering pipe 31 incline, cylindrical segments 37 are provided. These cylindrical segments 37 adjoin the inside walls of pipe 31 at the cutouts 31*a* and are hinged at 37*a* on the outside of the end of the discharge chamber. In the absence of these segments 37, part of the water flow from the discharge chamber outlet will escape through the cutout openings causing outflow disturbance, losses in thrust and inefficiency of steering. The use of the cylindrical segments 37 gives smoother change of direction to the flow of discharging water during the inclining of pipe 31 and limits the loss of thrust in steering. Steering is accomplished through an arm 35A connected to pipe 31. A control bar 35 operated by the steering system in the boat is connected to arm 35A and moves pipe 31 through it.

Figure 7:
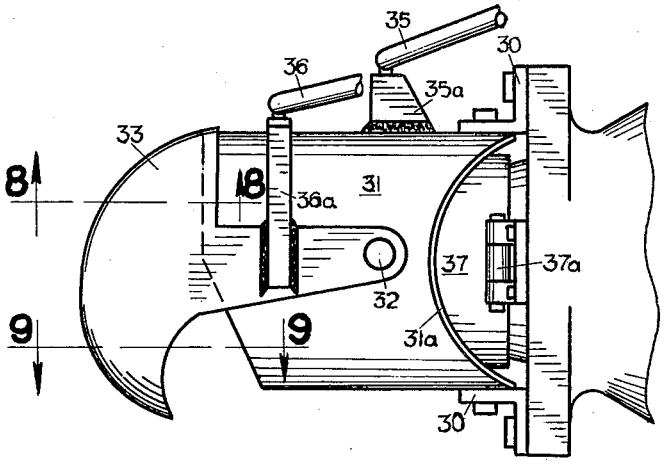
FIG. 7 is a side view of the control means, taken along line 7—7 in FIG. 6.
Figure 8:
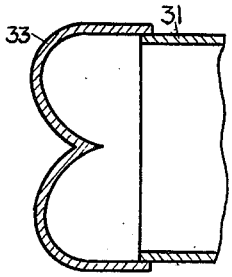
FIG. 8 is a sectional view of the reverser, taken along line 8—8 in FIG. 7.
Figure 9:
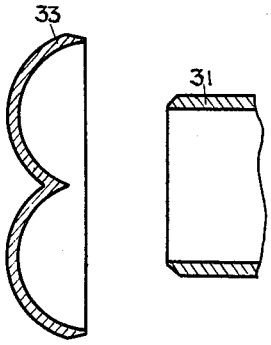
FIG. 9 is a sectional view of the reverser, taken along line 9—9 in FIG. 7.

The reversing means consists of two connected cups of special shape shown in FIGS. 5–9. Reverser 33 is pivoted at 32 on pipe 31 and is disposed above the pipe in its inoperative position. Pushing bar 36 aftwardly against arm 36A which is connected to reverser 33 results in the pushing down of the reverser to a stop position which turns it fully on. The action of the reverser in the closed position as shown in FIG. 7, is to direct the water flow from pipe 31 sideways and down with respect to the boat's bow.

Due to the reverser's mounting on pipe 31, it will be inclined with the pipe during change of direction. When the reverser is in closed position, direction steering during reversing is possible. The reverser in intermediate positions acts as a stopping means. Slight protruding of reverser 33 (in the closed position) below the lower edge of pipe 31, but above the level of mounting 30 and considerably above the keel level, has the advantage of rendering it resistant to damage in cases of hitting obstacles.

What is claimed is:

1. In an hydraulic jet propulsion system for watercraft of the type comprising:

a. an intake section for directing incoming water from under the craft;

b. a pump section for receiving incoming water from said intake section and increasing the energy thereof; and c. a discharge section for accelerating and discharging the increased energy water as a jet;

the improvement comprising:

d. an intake passage within said intake section comprising:

i. two substantially vertical side walls having lower edges at the same level and substantially parallel to each other;

ii. an aftwardly inclined front wall laterally joined to said side walls, and having a lower front portion cooperating with the lower edges of said side walls to form a parallel-sided intake opening with an aftward open end; and iii. a rear edge member disposed above the level of and at the aftward open end of said intake opening, which member is joined to said sidewalls and cooperates with said side walls and said front wall to form a substantially cylindrical outlet opening to said pump section.

2. A system as in claim 1 wherein said intake section is formed of fiberglass.

3. A system as in claim 2 wherein said intake section is integrally molded with the craft hull.

4. A system as in claim 2 further comprising a connecting ring molded into the end of said outlet opening adjacent to said pump section for connection thereto.

5. A system as in claim 1 wherein said rear edge member has an elliptically shaped leading edge in vertical section.

6. A system as in claim 1 further comprising a series of screening bars supported by said rear edge member and said front wall above the level of the intake opening and wherein said screening bars are of streamlined cross-section and arranged in parallel with each other and the axis of the craft and inclined to the direction of incoming water.

7. A system as in claim 1 wherein said intake section is disposed with the intake opening at the rear underside of the watercraft and with said rear edge member disposed at the transom of said watercraft.

8. A system as in claim 1 further comprising a bearing housing disposed in said front wall of said intake passage, and a drive shaft mounted in said bearing housing and extending through said intake passage into said pump section.

9. A system as in claim 8 wherein said front wall of said intake passage makes an angle with the axis of said drive shaft within the range from 15° to 30°.

10. A system as in claim 8 further comprising a passage in said bearing housing having an inlet in said front wall for admitting water to cool said bearing housing and said drive shaft.

11. A system as in claim 1 wherein said vertical side walls have rounded-off lower edges which terminate aftwardly in substantially vertical edges and said front wall is joined to said side walls by round-offs.

12. A system as in claim 1 wherein said lower front portion of said front wall is disposed substantially perpendicular to said lower edges of said side walls and the axis of the watercraft to form a three-sided substantially rectangular intake opening with an aftward open end.

13. In an hydraulic jet propulsion system for watercraft the combination comprising:

an intake means for directing incoming water from under the craft, said intake means comprising:
- i. means for defining an intake passage;
- ii. means for defining in the underside of the craft a parallel-sided intake opening to said intake passage with an aftward open end; and
- iii. means disposed above said aftward open end for defining a cylindrical outlet opening from said intake passage;

b. a pump means for receiving incoming water from said intake section and increasing the energy thereof, said pump means comprising:
- i. a cylindrical casing disposed aft of and in axial alignment with said cylindrical outlet opening;
- ii. at least one set of straightener vanes fixed in said casing;
- iii. at least one rotatable impeller disposed upstream of said straightener vanes; and
- iv. drive means for rotating said impeller; and c. a discharge means for accelerating and discharging the increased energy water as a jet, said discharge means comprising:
- i. an annular casing disposed aft of and axially aligned with said cylindrical casing;
- ii. means for defining an acceleration chamber with an aftwardly diminishing interior diameter within aid annular casing;
- iii. an outlet end integral with said annular casing; and
- iv. means within said outlet end for defining a cylindrical opening at the exit of said acceleration chamber.

14. A system as in claim 13 further comprising a hub member for mounting said straightener vanes and a plastic bearing within said hub member for supporting said drive means in rotation and having axial grooves therein for permitting the passage of water for lubricating said bearing.

15. A system as in claim 13 wherein the impeller blades are mounted with a pitch in the range from 3½ to 6½ inches.

16. A system as in claim 13 wherein the impeller blades have outer and inner profiles of a laminar configuration with the maximum offset thickness of the outer profile toward the aft end and of the inner profile at the middle of the blade length and with the maximum offset thickness of the intermediate profiles lying along a straight line between those of the inner and outer profiles.

17. A system as in claim 13 wherein the impeller has a freeflow opening in the range from 0 to 20% of the total area of the flow passage.

18. A system as in claim 13 wherein the maximum relative thickness of the impeller blade outer profile is in the range from 2% to 4% and of the inner profile is in the range from 6% to 10%.

19. A system as in claim 13 wherein the straightener vanes have a curved leading surface and a flat trailing surface, the length of the flat trailing surface decreasing from the outer profile to the inner profile.

20. A system as in claim 19 wherein said straightener vanes are mounted with their flat trailing surfaces at an angle with the axis of rotation of said impeller in the range between 3° and 6° in the direction opposite to that of impeller rotation.

21. A system as in claim 19 wherein the curvature of the inner and outer profiles of the curved leading surface varies in accordance with the points of intersection between the centerlines of the continuum of profiles along the leading edge and the tangential flow therealong.

22. A system as in claim 13 wherein the number of straightener vanes is one more than the number of impeller blades.

23. An hydraulic jet propulsion system for watercraft comprising:

a. an intake passage comprising:
- i. two substantially vertical parallel sidwalls;
- ii. an aftwardly inclined front wall with the lower portion of said front wall joining the lower edges of said side walls to form an intake opening; and
- iii. a rear edge member disposed at the transom of said watercraft above the level of said intake opening and joining with said side walls in such manner that said edge member, said front wall and said side walls form a cylindrical opening aft of said transom;

b. a pump assembly disposed at said outlet opening and comprising:
- i. a cylindrical casing axially aligned with said cylindrical outlet opening;

ii. a plurality of straightener vanes mounted within said cylindrical casing;

iii. an impeller disposed upstream of said straightener vanes; and iv. drive means for mounting and rotating said impeller; and c. a discharge chamber disposed aft of said pump assembly comprising:

i. an acceleration chamber axially aligned with said cylindrical casing and formed of an annular wall of aftwardly diminishing cross-section; and ii. a cylindrical outlet end at the exit of said acceleration chamber.

24. A system as in claim 23 wherein said discharge chamber further comprises a cylindrical intake chamber forward of said acceleration chamber and containing the aft portion of said pump assembly and said acceleration chamber comprises an interiorly unobstructed wall whose cross-section diminishes in accordance with the rule of minimal flow losses.

25. A system as in claim 23 wherein said lower portion of said front wall is disposed substantially perpendicular to the axis of said watercraft to form a three-sided substantially rectangular intake opening.

26. A system as in claim 23 further comprising:

d. an annular ring member disposed about said cylindrical outlet opening of said intake passage with a first annular flange thereon;

e. second and third annular flanges on opposite ends of said cylindrical casing, the face of said second flange engaging the face of said first flange;

f. a fourth annular flange on the discharge chamber having a face engaging said third flange; and g. means for sealing maintaining the engagement between said faces of said flanges.

27. A system as in claim 26 wherein said maintaining means comprises a split ring member having an inner annular recess for accommodating a set of engaged flanges therein and means for tightening said ring member to cause the walls of said recess to securely engage the non-engaging surface of said flanges.

28. A system as in claim 23 further comprising:

d. steering means mounted on the cylindrical outlet end of said discharge chamber for pivoting about a substantially vertical axis; and e. reverser means mounted on said steering means for pivoting about a substantially horizontal axis between an operative position and an inoperative position and comprising a dual cup member formed with a dividing wall which is disposed substantially vertically when said reverser means is in the operative position.

29. A system as in claim 23 wherein said discharge chamber is formed of fiberglass.

30. In an hydraulic jet propulsion system for watercraft of the type comprising:

a. a pump means for receiving incoming water and increasing the energy thereof; and b. a discharge means for accelerating and discharging the increased energy water as a jet; the improvement wherein said discharge means comprises:

c. a cylindrical outlet end; and d. means mounted on said cylindrical outlet end for steering said watercraft comprising:

i. a cylindrical member having side cutouts at its inlet end;

ii. pivot means for mounting said cylindrical member on said cylindrical outlet end for pivoting about a substantially vertical axis; and iii. cylindrical sectors pivoted on said outlet end and disposed within said cutouts.

* * * * *

UNITED STATES PATENT AND TRADEMARK OFFICE

CERTIFICATE OF CORRECTION

PATENT NO. : 3,993,015

DATED : November 23, 1976

INVENTOR(S) : Janusz Klepacz and Joseph Menet

It is certified that error appears in the above-identified patent and that said Letters Patent are hereby corrected as shown below:

Col. 4, line 31, "junction" should read --junctions--;

Col. 5, line 40, "RPN" should read --RPM--;

Col. 6. line 11, "16a" should read --16b--;

line 47, "is" should read --its--;

line 48, "16" should read --18--;

Col. 10, line 3, "aid" should read --said--;

line 23, "thickness" should read --thicknesses--;

Col. 12, line 6, "surface" should read --surfaces--.

Signed and Sealed this

First Day of March 1977

[SEAL]

*Attest:*

RUTH C. MASON
*Attesting Officer*

C. MARSHALL DANN
*Commissioner of Patents and Trademarks*